US006546881B1

(12) United States Patent
Wiesner

(10) Patent No.: US 6,546,881 B1
(45) Date of Patent: Apr. 15, 2003

(54) EXPANDABLE CASH BOX

(75) Inventor: Joel Wiesner, St. Peters, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 0 days.

(21) Appl. No.: 09/942,128

(22) Filed: Aug. 29, 2001

(51) Int. Cl.[7] ..... E05G 1/00

(52) U.S. Cl. ..... 109/45; 109/49; 109/147; 232/15; 232/16

(58) Field of Search ..... 109/45, 49, 147; 232/15, 16; 209/534

(56) References Cited

U.S. PATENT DOCUMENTS

| | | | | |
|---|---|---|---|---|
| 2,761,581 | A | 9/1956 | Cohee | 220/1.5 |
| 3,655,186 | A | 4/1972 | Bayha | 271/88 |
| 3,656,615 | A | 4/1972 | Ptacek | 209/73 |
| 3,917,260 | A | 11/1975 | Okkonen et al. | 271/181 |
| 3,918,359 | A | 11/1975 | Hennells et al. | 100/52 |
| 4,212,415 | A | 7/1980 | Neely | 222/231 |
| 4,491,269 | A | 1/1985 | Sweazey et al. | 232/43.2 |
| 4,678,072 | A | 7/1987 | Kobayashi et al. | 194/206 |
| 4,775,824 | A | 10/1988 | Barnes et al. | 318/567 |
| 4,809,966 | A | 3/1989 | Kobayashi et al. | 271/181 |
| 4,809,967 | A | 3/1989 | Kondo | 271/181 |
| 5,209,395 | A | 5/1993 | Zouzoulas et al. | 232/15 |
| 5,322,275 | A | 6/1994 | Gardellini et al. | 271/306 |
| 5,333,714 | A | 8/1994 | Watabe et al. | 194/206 |
| 5,756,985 | A | 5/1998 | Holste et al. | 235/475 |
| 5,829,673 | A | 11/1998 | Harr, Jr. | 232/15 |

FOREIGN PATENT DOCUMENTS

EP 665520 A2 4/1995

OTHER PUBLICATIONS

"BA30 Bill Acceptor Operation and Service Manual" authored by Coin Acceptors, Inc. printed in USA, Mar. 1995.

*Primary Examiner*—Anthony Knight
*Assistant Examiner*—Lisa Bannapradist
(74) *Attorney, Agent, or Firm*—Polster, Lieder, Woodruff & Lucchesi, L.C.

(57) ABSTRACT

An expandable cash box system for storing bills including a chassis housing attachable to a bill validator and having an open end adapted to receive bills from the validator and a sliding enclosure housing disposed in telescopic relation to the chassis housing. A spring-loaded compressor plate is provided within the two housings and a control system between the two telescoping housing determines the expansion as bills are received by the cash box. The control system may include interengaging resilient members and a set of grooves receiving the resilient members and a guidance system facilitates the alignment of the two housings.

24 Claims, 15 Drawing Sheets

EXPANDABLE CASH BOX

BACKGROUND OF THE INVENTION

This invention relates generally to cash boxes for use in conjunction with currency handling devices for vending machines, and the like, and particularly to an expandable cash box for bill validator devices which provides automatic enlargement of the cash box capacity during use.

Devices which transport, validate and stack currency and particularly those which stack and store bills are wellknown in the vending and entertainment industry. Such devices are often used in conjunction with vending machines which typically include a bill transport system which validates and delivers bills to a cash box, in which the bills are stacked following validation and prior to collection.

In general, such cash boxes have a fixed capacity and are intended to hold a specified number of bills. A typical cash box is integrally formed with the bill validator or is attached to the validator by means of an adapter and includes a lid or cover by which bills can readily be accessed.

Vending machine capacity requirements are continually increasing to cater to increasing product prices and cash boxes capacity requirements have similarly increased. This demand is satisfied by providing variable capacity cash boxes which are selected to suit the capacity need. However, such customized cash boxes require an inventory of various cash box sizes.

A recent improvement has been the development of modular cash box units which can be snapfitted together to provide the desirable capacity. A cash box of this type is disclosed in U.S. Pat. No. 5,829,673 owned by the assignee of the present invention. Such cash boxes work well but require removal and replacement of the desired number of units to suit a particular capacity.

This invention solves this and other problems and provides increased cash box capacity in a manner not revealed or suggested in the known prior art.

SUMMARY OF THE INVENTION

This enlarged capacity cash box is particularly suitable for bill handling and validating devices and utilizes an expandable feature which automatically adjusts to the desired size by virtue of telescoped interconnected housing portions which expand under pressure from the received bills urged into the cash box by a bill validator stacking plunger.

The cash box includes a first housing providing a chassis which nests inside a second housing providing a sliding enclosure. As the number of bills pushed in the cash box increases, a pressure builds up which causes the sliding enclosure to slide away from the chassis. This sliding motion expands the size of the cash box, allowing more bills to be stored inside. This expansion continues until either the box reaches its maximum size or the sliding enclosure encounters resistance from the vending mac hine in which it is mounted.

A particular advantage of this expandable capacity cash box is that it expands in size to optimize dollar bill capacity to the vending machine envelope that it is mounted in. Another advantage is that it can be collapsed to a nominal size for shipping, inventory, to fit within small enclosures, and when in use can be collapsed to prevent crushing. Yet another advantage is that field personnel do not need to determine the appropriate size of cash box to usewith exactitude.

This expandable cash box system for storing bills includes a first housing portion providing a chassis having an open end adapted to receive a bill from a bill validator to which it is attached. The cash box includes a second housing portion providing a sliding enclosure disposed in telescopic sliding relation to the first housing. A spring-loaded compressor plate is disposed within said housing portions and adapted to stack and store bills within said housing portions. The cash box includes means for controlling the sliding telescopic relation between said housing portions and thereby the capacity of the cash box.

It is an aspect of this invention to provide that said means for controlling the telescopic relation between the housing portions includes interacting index members.

It is another aspect of this invention to provide that said means for controlling the telescopic sliding relation between the housing portions includes ratchet means.

It is an aspect of this invention to provide that the said first housing portion includes opposed side walls each having a plurality of grooves and the second housing portion includes opposed side walls disposed adjacent associated side walls of the first housing portion and including at least one resilient finger selectively engageable with said grooves.

It is still another aspect of this invention to provide guide means between the housing portions for guiding the housing portions during relative telescopic movement to maintain alignment between said portions.

It is yet another aspect of this invention to provide that the guide means includes cooperating slots and projections received by the slots in guided relation.

It is still another aspect of this inveniton to provide that one of said housing portions includes at least one slot having associated slot ends and the other of said housing includes a stop engageable with an associated slot end to prevent separation of said housing portions.

It is yet another aspect of this invention to provide that said second housing portion includes an upper portion providing a bill accessible opening, and a cover is provided for said opening.

It is an aspect of this invention to provide that said recesses include elongate slots, and said projections include T-shaped members received by said slots in retained relation.

Still another aspect of this invention to provide means for providing a flat interior surface within the cash box to facilitate movement of bills therewithin.

It is another aspect of the invention to provide that the means for controlling the sliding telescopic relation between said housing portions includes friction resistance between the housing portions.

It is still another aspect of the invention to provide that the means for controlling the sliding telescopic relation between said housing portions includes stop means between said portions, and another aspect to provide that said control means includes an external stop means provided by the vending machine.

This expandable cash box is relatively simple in construction, inexpensive to manufacture and easy to use.

DESCRIPTION OF THE PREFERRED EMBODIMENT

Figure 1:
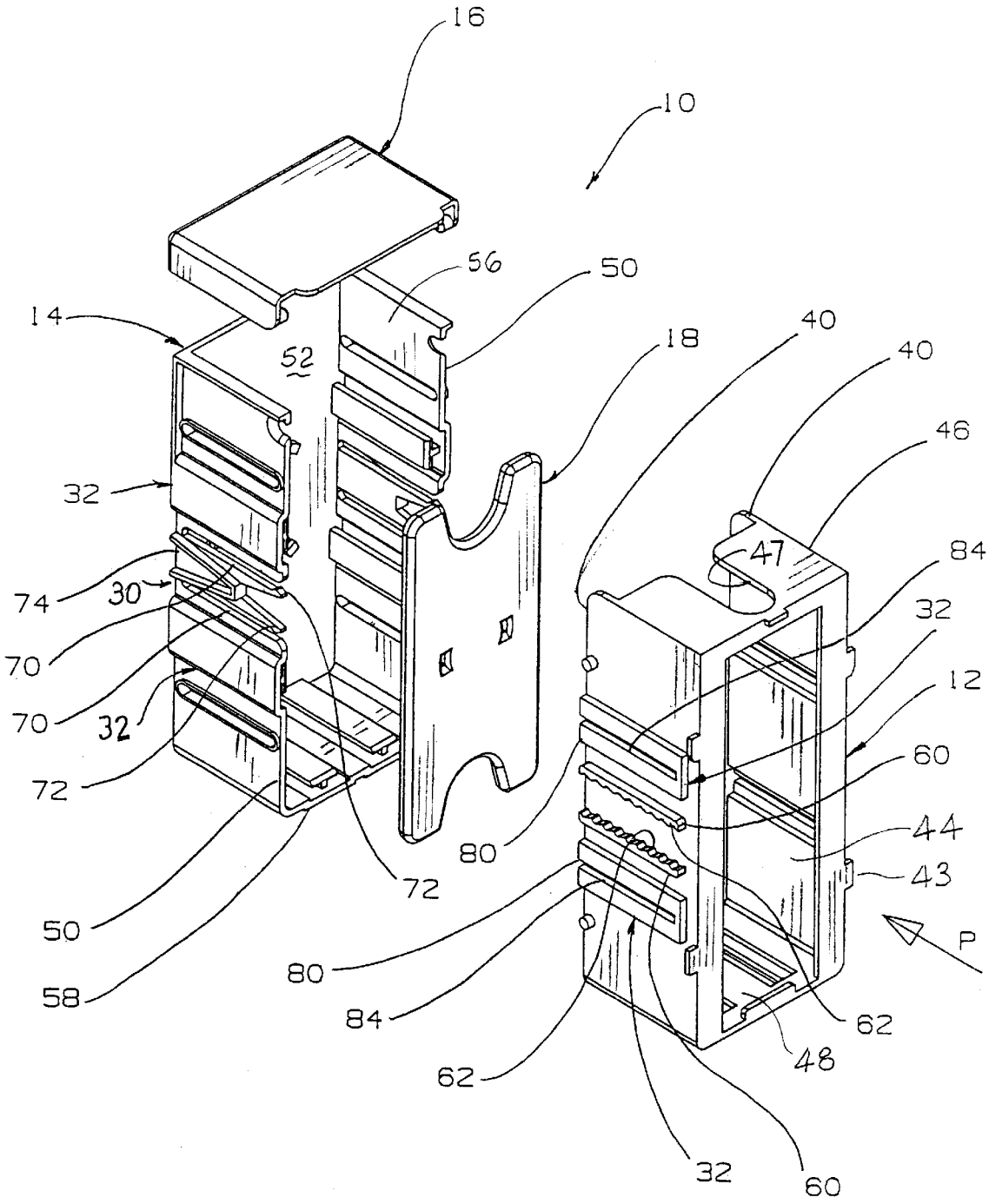
FIG. 1 is an exploded perspective view of the cash box showing its principal parts.
Figure 2:
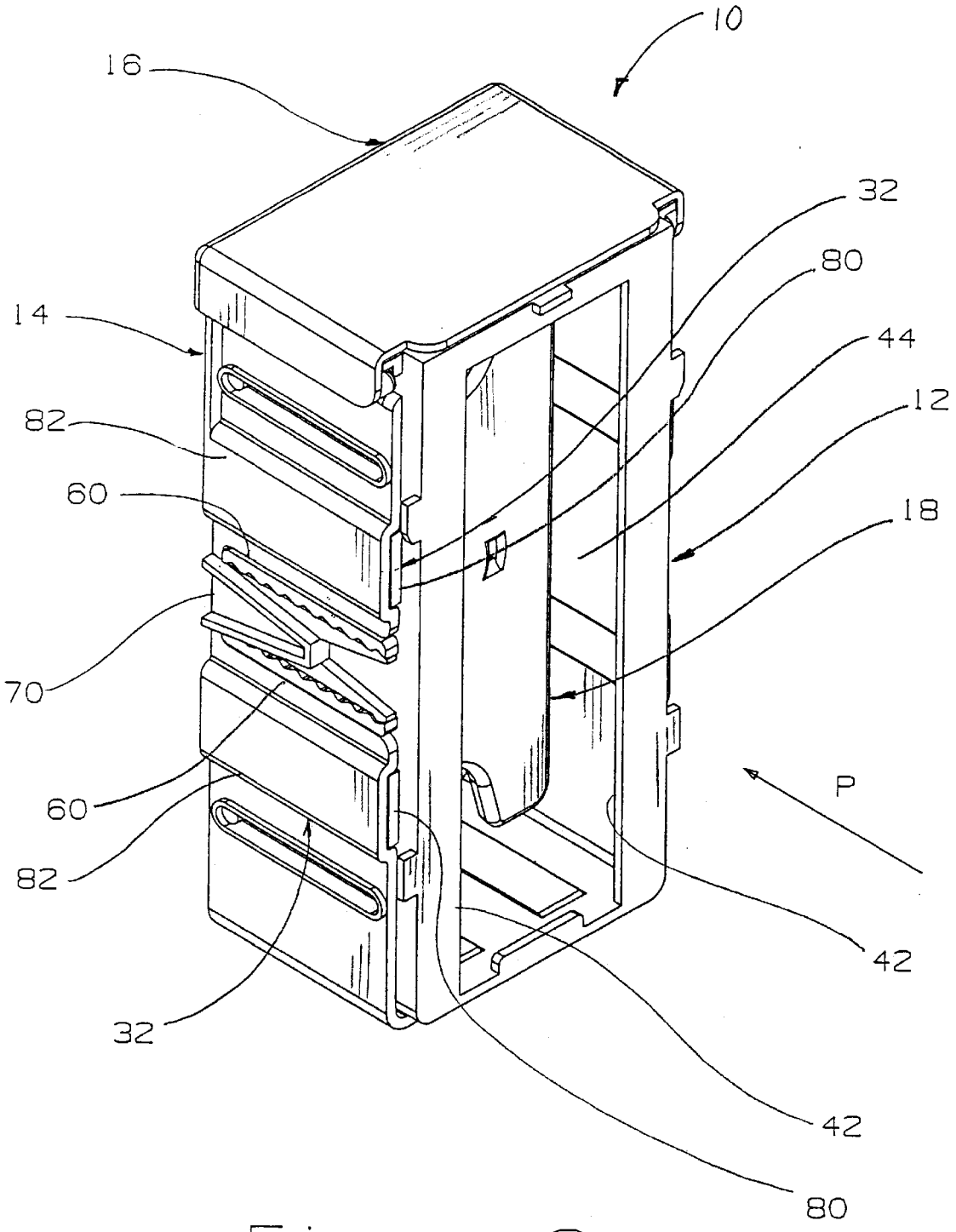
FIG. 2 is a perspective view of the cash box in its fully collapsed condition.
Figure 3:
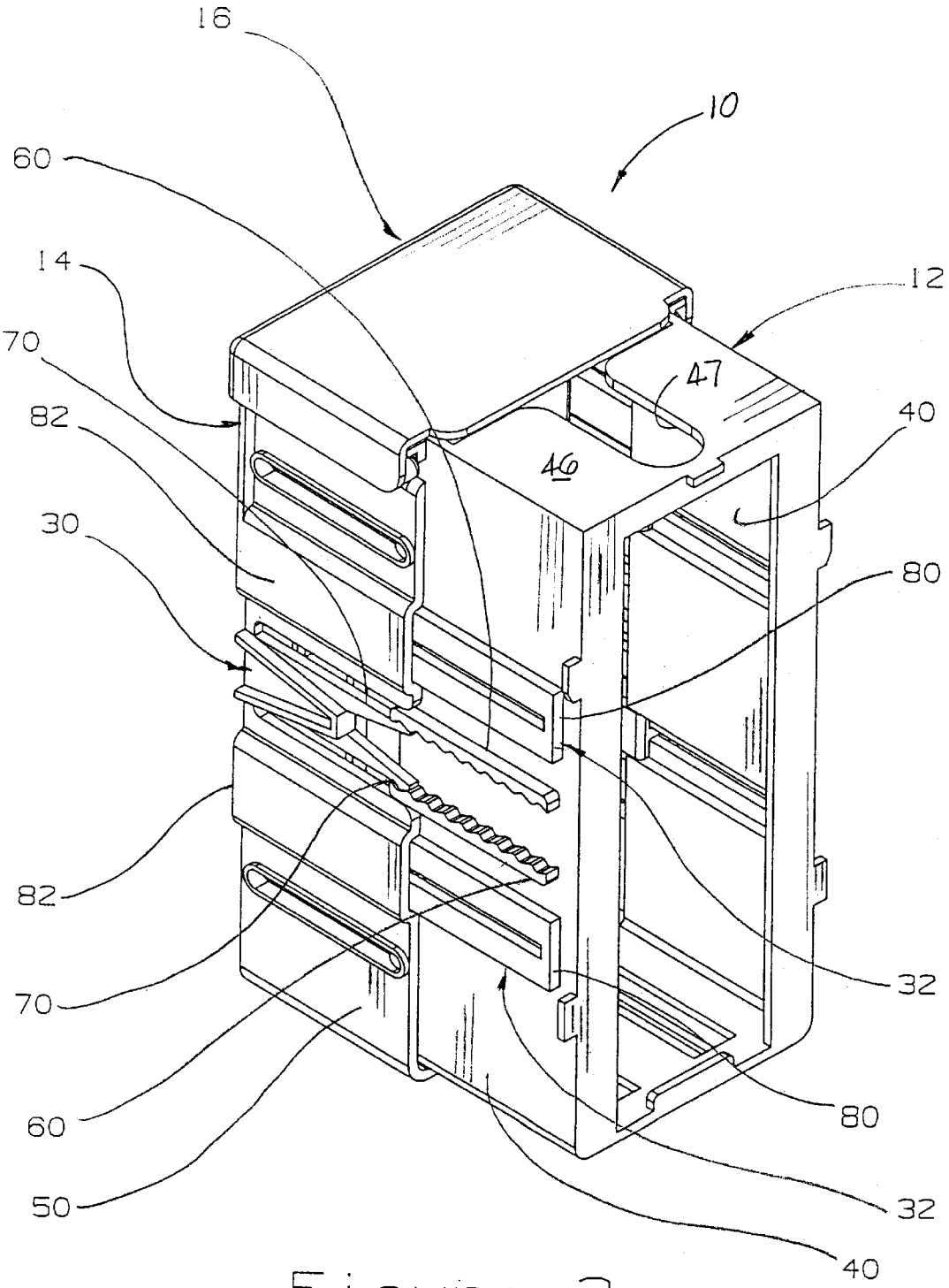
FIG. 3 is a perspective view of the cash box in its fully expanded condition.
Figure 4:
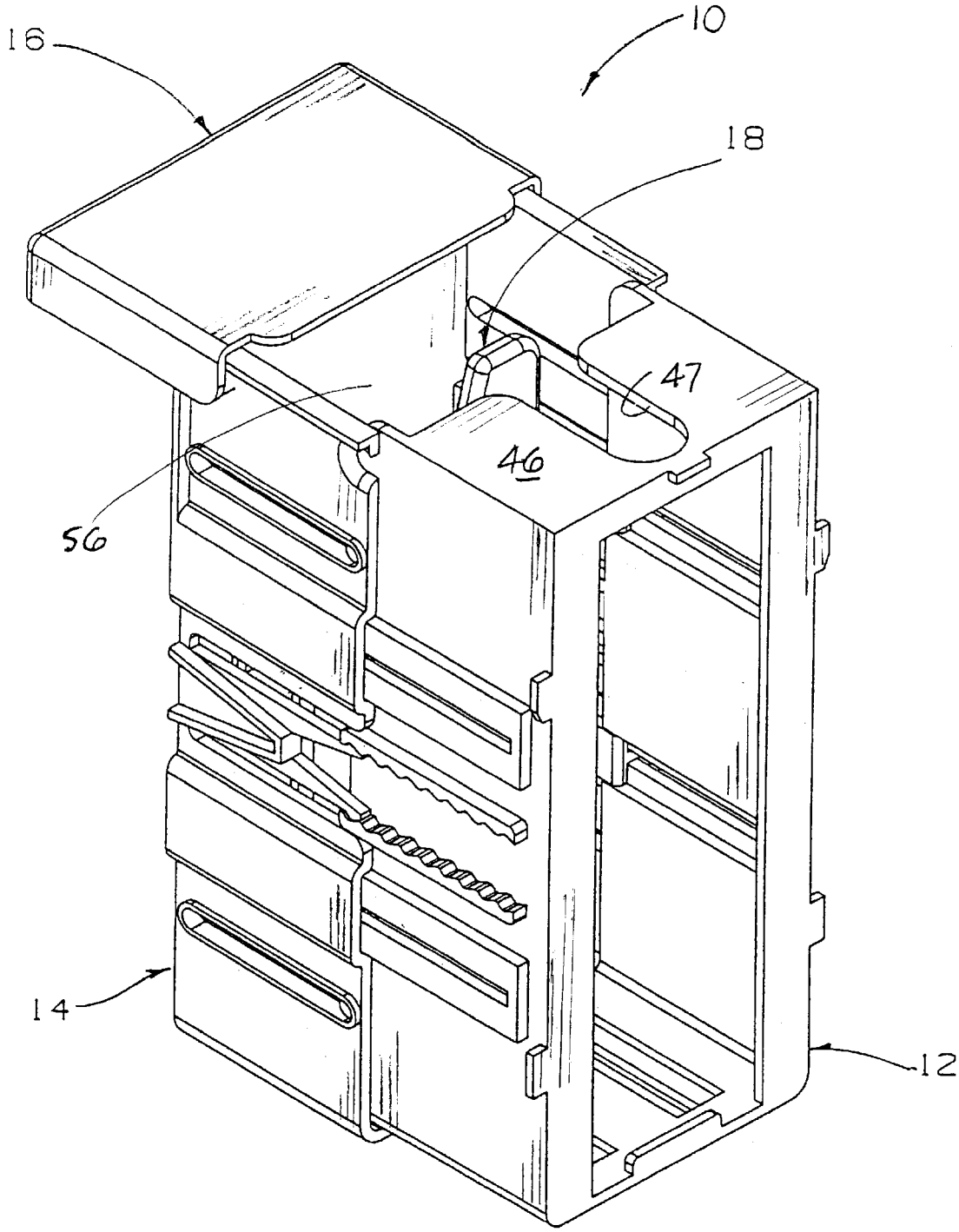
FIG. 4 is a view similar to FIG. 3 but with the cover open.

Referring now by reference numerals to the drawings, and first to FIGS. 16, it will be understood that the expandable cash box 10 includes a cash box chassis 12 removably attached to the bill validator 100 and constituting a first housing portion, a sliding enclosure 14 received by the chassis 12 in telescopic sliding relation, and constituting a second housing portion; a top cover 16 connectible to the sliding enclosure 14 and providing a lid, and a compression plate 18. The compression plate 18 is connected to the sliding enclosure 14 by a spring 20 (FIG. 15) and is movable between the chassis 12 and the sliding enclosure 14 under pressure from a stacking plunger P, carried by the bill transporting portion of the bill validator 100. The plunger P is shown diagrammatically by an arrow in the drawings, for example, FIGS. 5 and 15. As will now be described, the chassis 12 and the sliding enclosure 14 are connected by control means indicated by numeral 30 and guide means generally indicated by numeral 32.

The chassis 12 includes opposed side walls 40, partial end walls 42 extending inwardly from the side walls 40 to define a bill-receiving front end opening 44, a top wall 46 connecting the end walls 42 and a bottom wall 48 connecting the side walls 40, lugs 43 provide a means of connecting the chassis 12 to the bill validator 100. The sliding enclosure 14 includes opposed side walls 50, a rear wall 52 connecting the side walls 50, and there is an upper bill accessible opening 56 between the side walls 50 and a bottom wall 58 connecting the side walls 50. There is no front wall.

The top cover 16 extends between the side walls 50 and is hingedly connected to the top portion of said side walls and slidably related thereto to provide access to bills therewithin, as will be described.

The control means 30 between the chassis 12 and the sliding enclosure 14 in the embodiment shown in FIGS. 1–11 is provided by the: configuration of adjacent side walls 40 and 50 of the chassis 12 and the sliding enclosure 14, respectively. This arrangement is best shown by reference to FIGS. 3, 5 and 11. As shown, the side walls 40 of the chassis 12 include opposed elongate elements 60 molded or otherwise provided on said side walls and configured to form a plurality of grooves 62. The side walls 50 of the sliding enclosure 14 include opposed inclined prongs 70, which extend forwardly from a relatively rigid base 74 and include outwardly extending projections 72 at the tips of the prongs 70. The prongs are arranged to be resiliently and intermittently engageable with said grooves 62 by virtue of the distance across the prong projections being greater than the minimum inside distance between the peaks of the grooves. Thus, in order to move the prong projections 72 longitudinally of the grooves 62, the resilient prong projections 72 must move toward each other by spring action of said prongs. In effect, the prongs 70 and grooves 62 provide interacting indexing members in the nature of a ratchet means.

The guide means 32 between the chassis 12 and the sliding enclosure 14 is also provided by the configuration of the adjacent side walls 40 and 50 of the chassis 12 and the sliding enclosure 14, respectively, assisted by the configuration of adjacent bottom walls 48 and 58 of the chassis 12 and the sliding enclosure 14, respectively. To this end, the sidewalls 40 and bottom wall 48 of the chassis 12 are formed in longitudinally extending channels 80 providing recesses which interfit longitudinally extending channels 82 formed into the sidewalls 50 and bottom walls 58 of the sliding enclosure 14 and providing compatible recesses. More particularly, said chassis channels 80 include open-ended slots 84 and said sliding enclosure channels 82 include T-shaped projections 86 received by said slots 84 in overlapping relation. This arrangement provides the cash box, as best shown in FIG. 11, with a flat interior surface within the cash box 10 which facilitates movement of bills therewithin.

Figure 6:
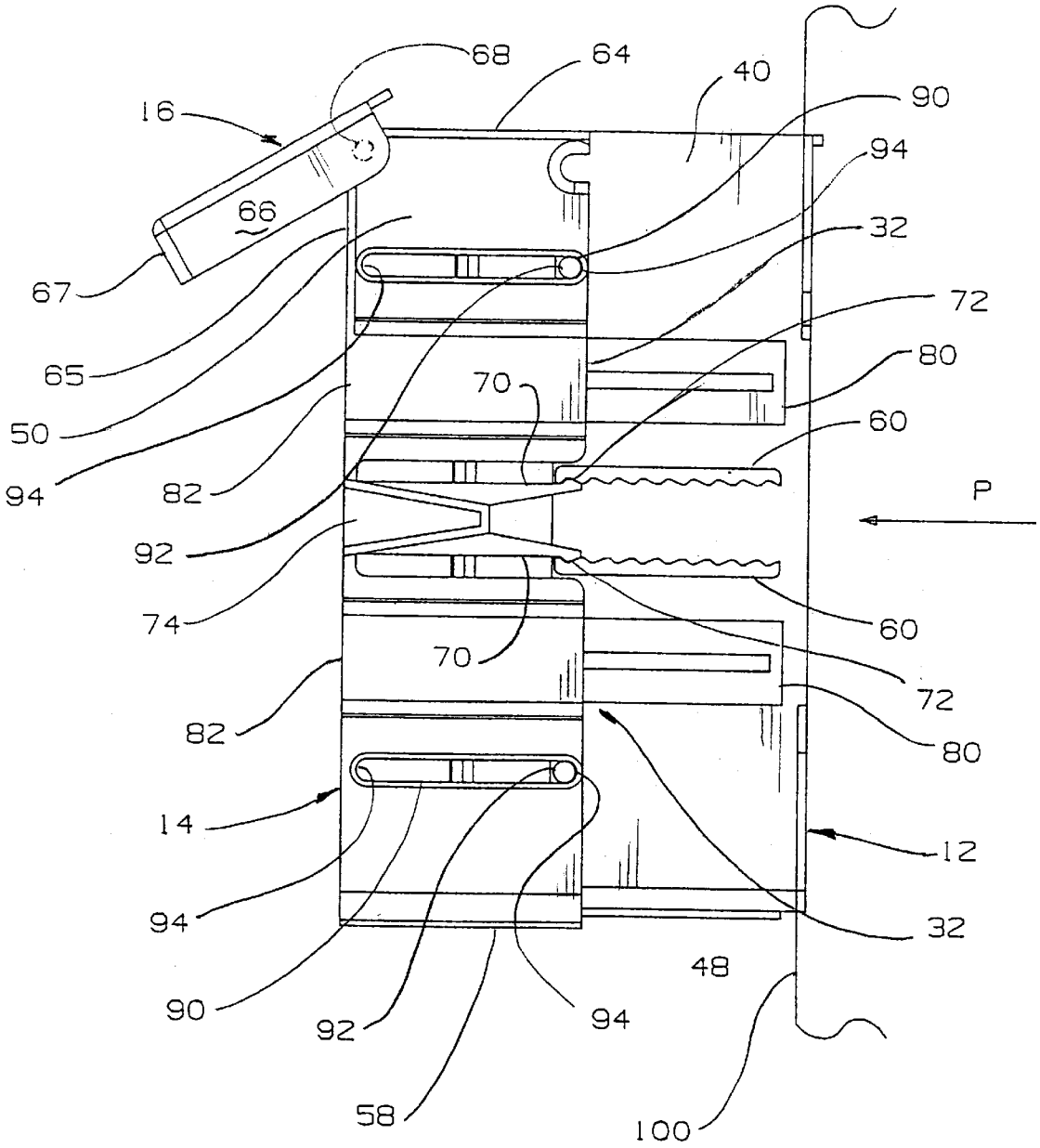
FIG. 6 is a similar view to FIG. 5 with the cash box in its fully expanded condition and with the cover open.
Figure 7:
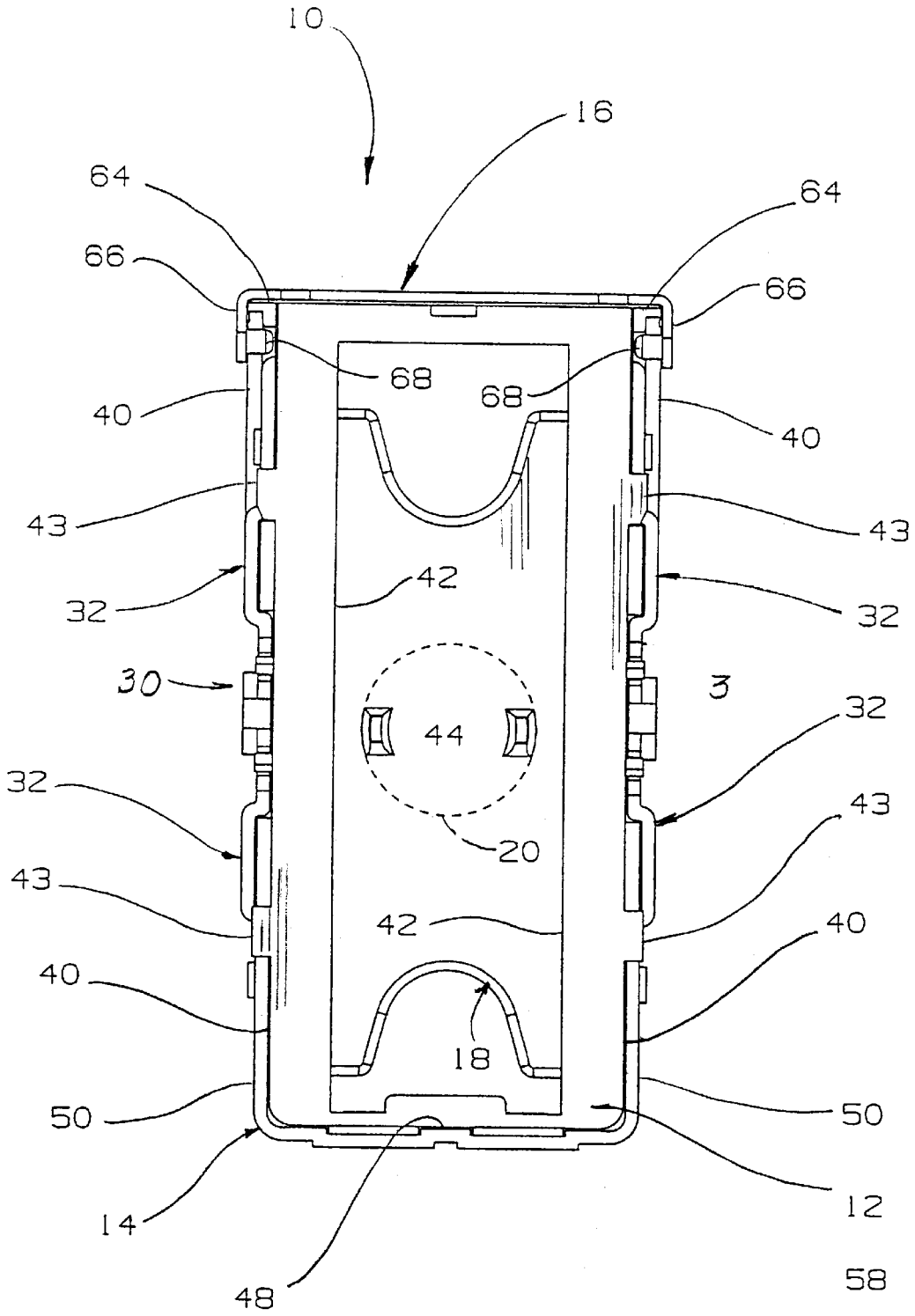
FIG. 7 is a front view of the cash box showing the open, bill-receiving end.
Figure 8:
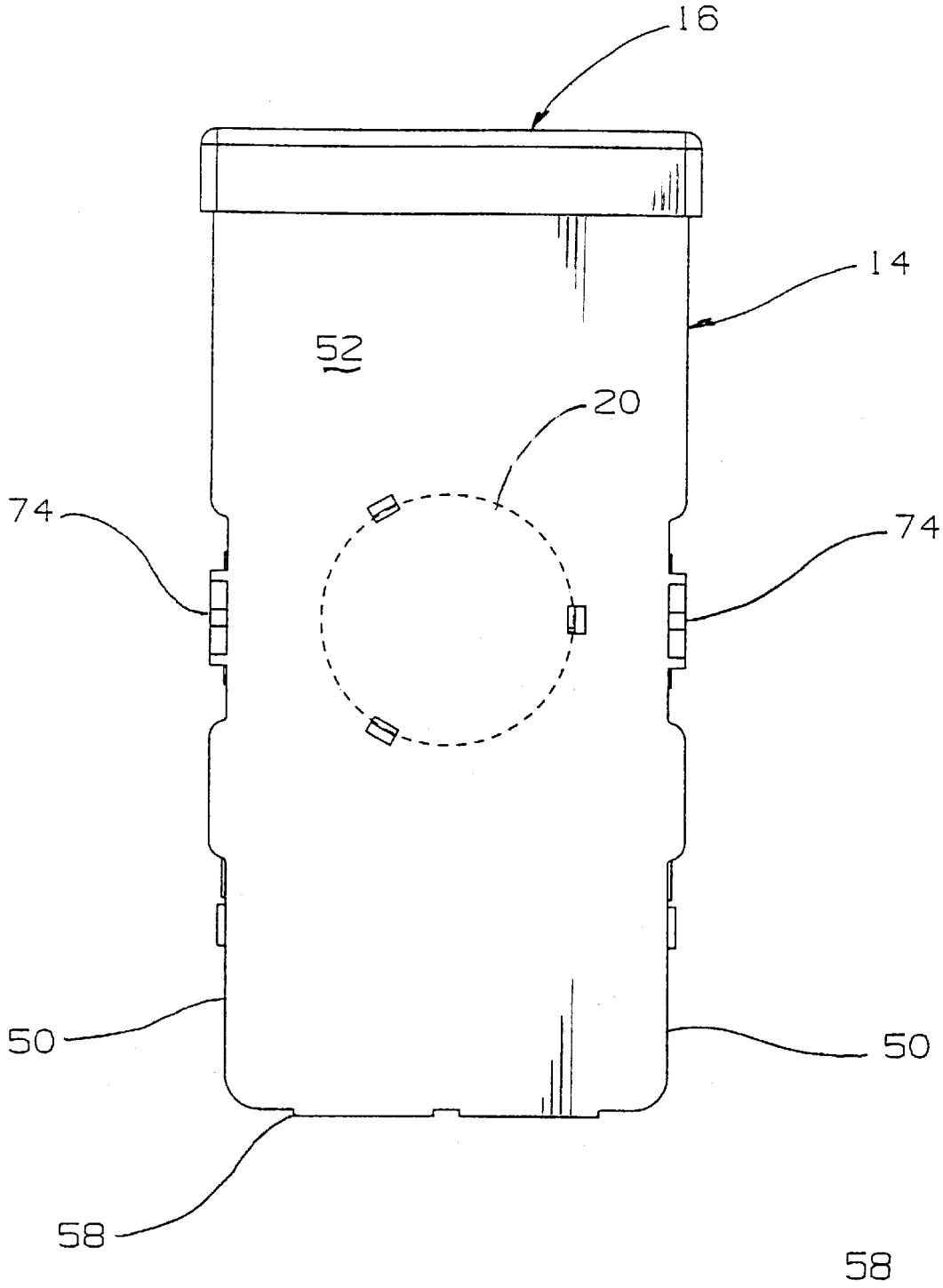
FIG. 8 is a rear view of the cash box showing the closed end.
Figure 9:
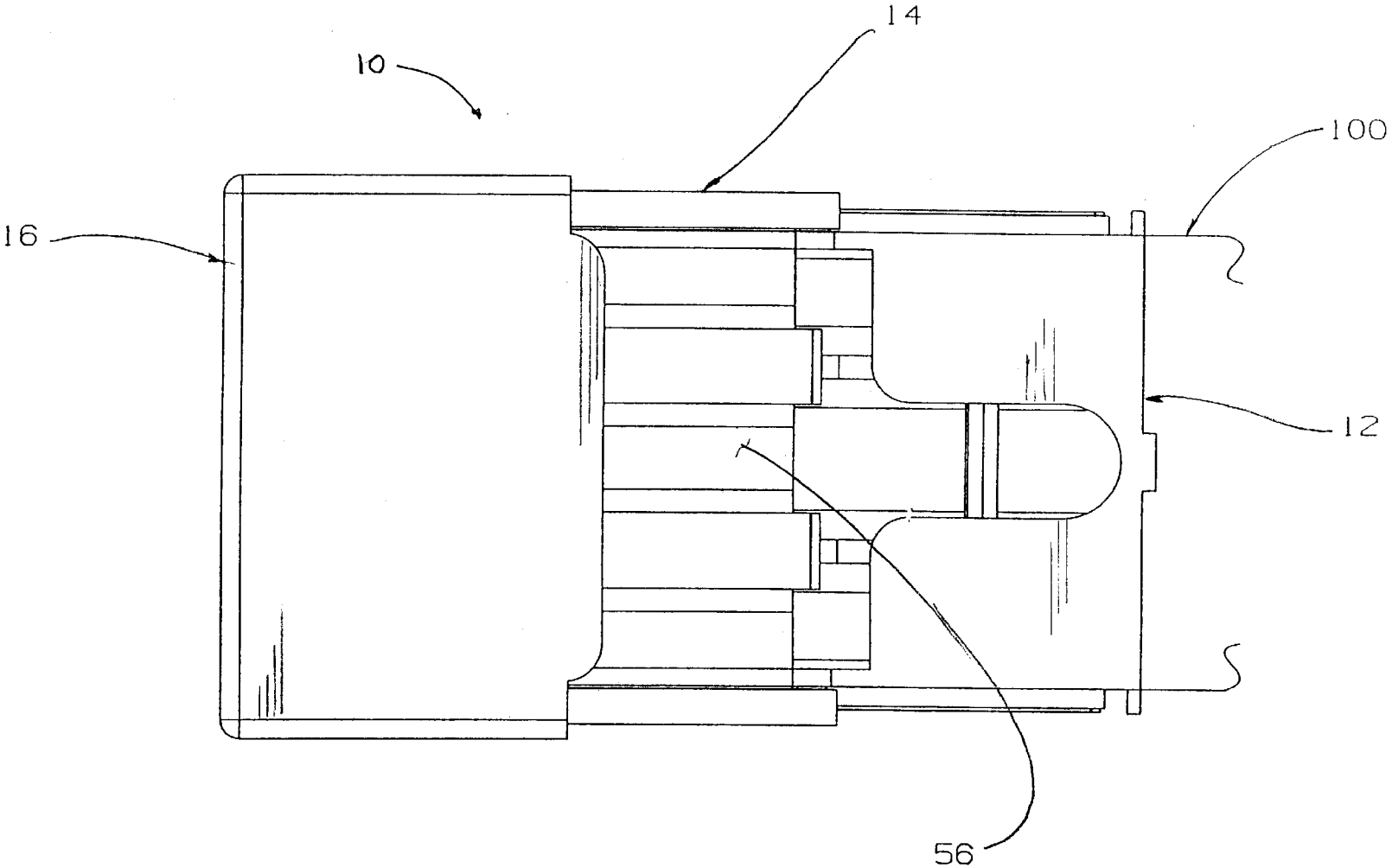
FIG. 9 is a top plan view showing the cash box in the expanded condition with the cover open.
Figure 10:
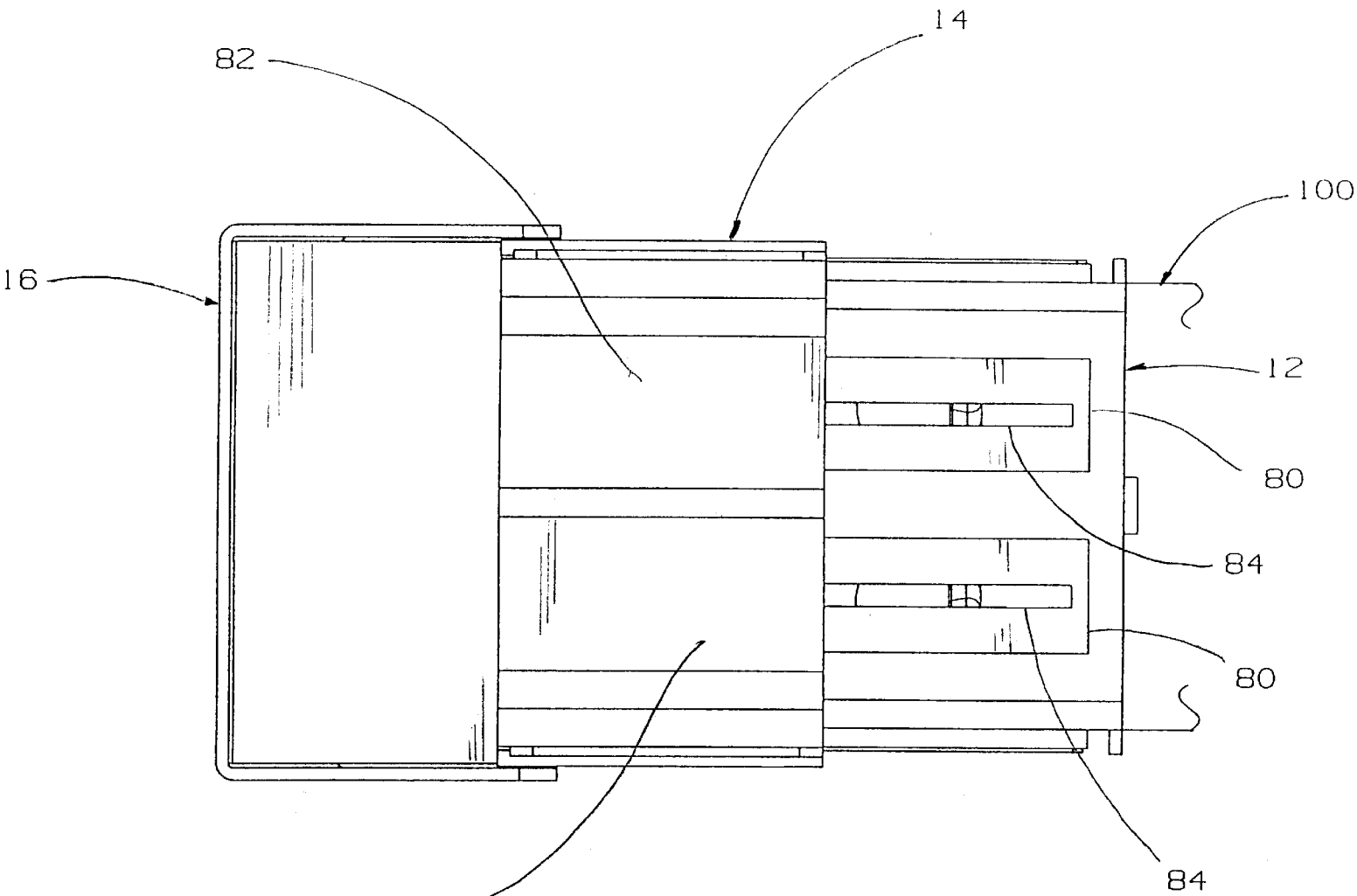
FIG. 10 is a bottom plan view showing the cash box in the expanded condition.

As best shown in FIGS. 6 and 7, the sliding enclosure side walls 50 include upper and end retaining flanges 64 and 65, respectively. The cover 16 includes side and rear depending flanges 66 and 67, respectively, each of said side flanges having a pin 68 engageable with said retaining flanges when the cover 16 is in the open position.

Figure 5:
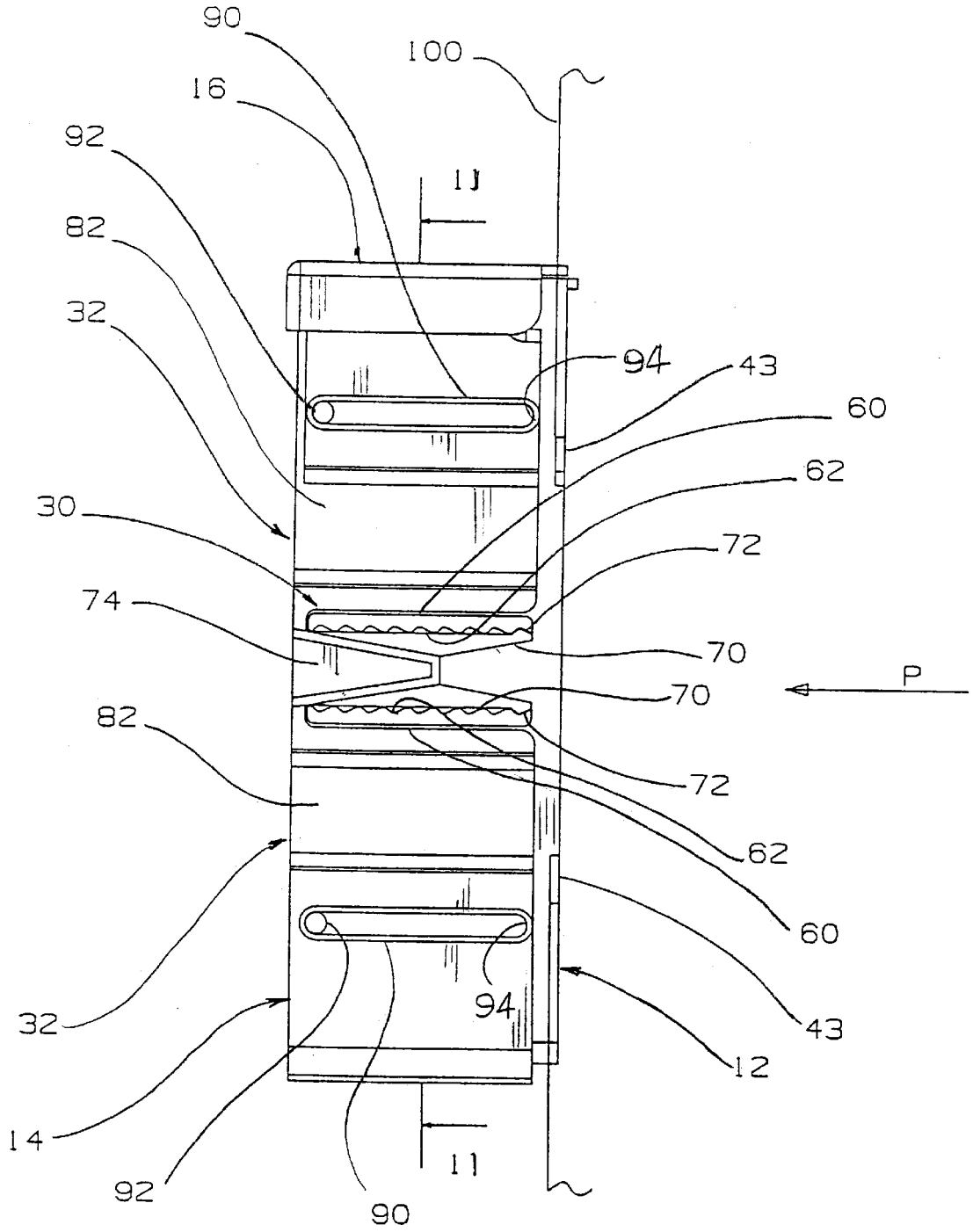
FIG. 5 is an elevational view of the cash box in its fully collapsed condition and with the cover closed.
Figure 11:
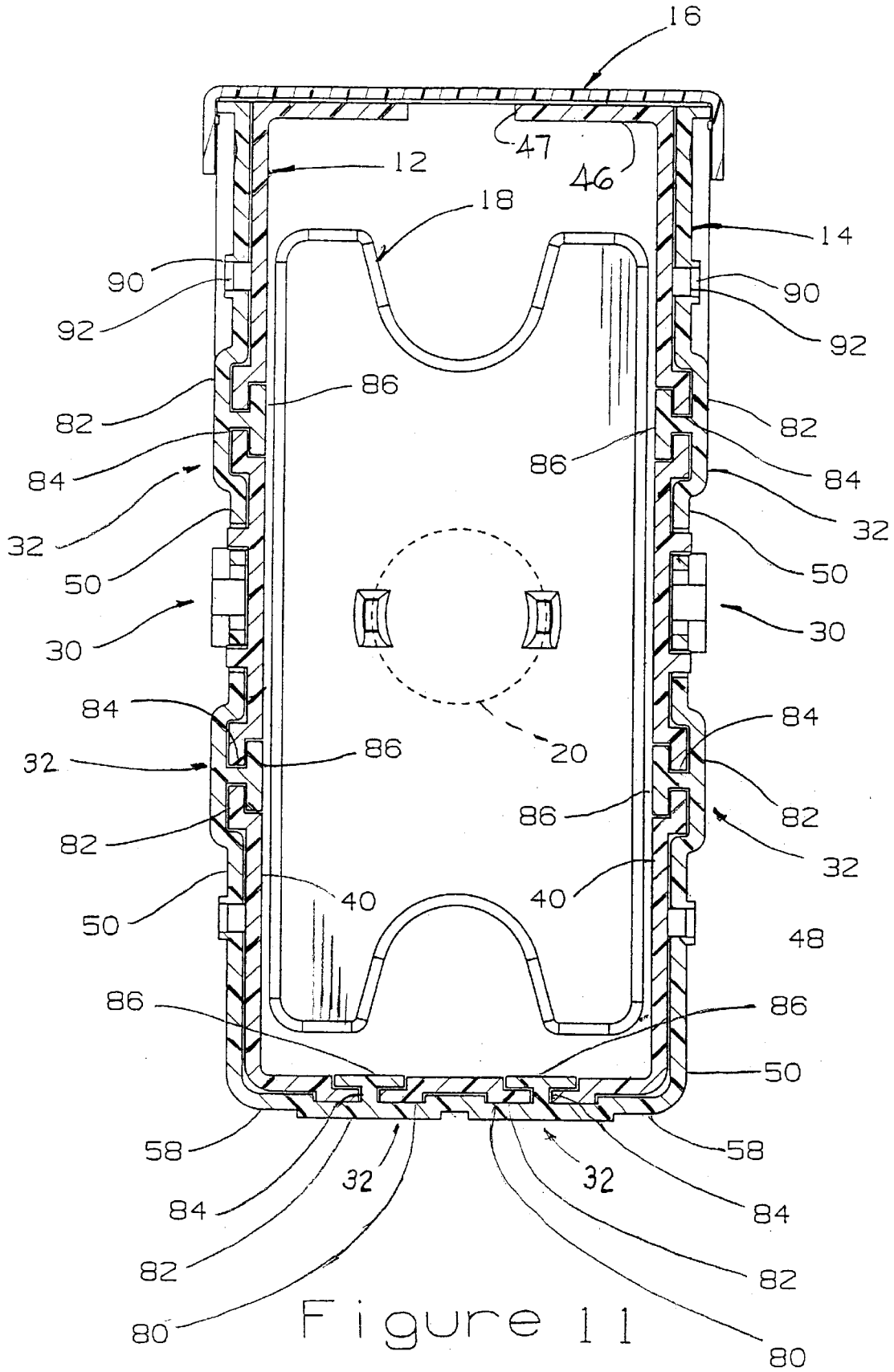
FIG. 11 is a cross-sectional view taken on. Line 11—11 of FIG. 5.

Also, as shown in FIGS. 5, 6 and 11, each sidewall 50 of said sliding enclosure 14 includes upper and lower slots 90 and each sidewall of said chassis 12 includes stop pin elements 92, constituting projections, engageable with said slot ends 94 to retain said sliding enclosure 14 on said chassis 12 in both expanded and collapsed positions. This arrangement provides an additional control means which prevents the sliding enclosure 14 from separation from the chassis 12 at maximum expansion.

Figure 12:
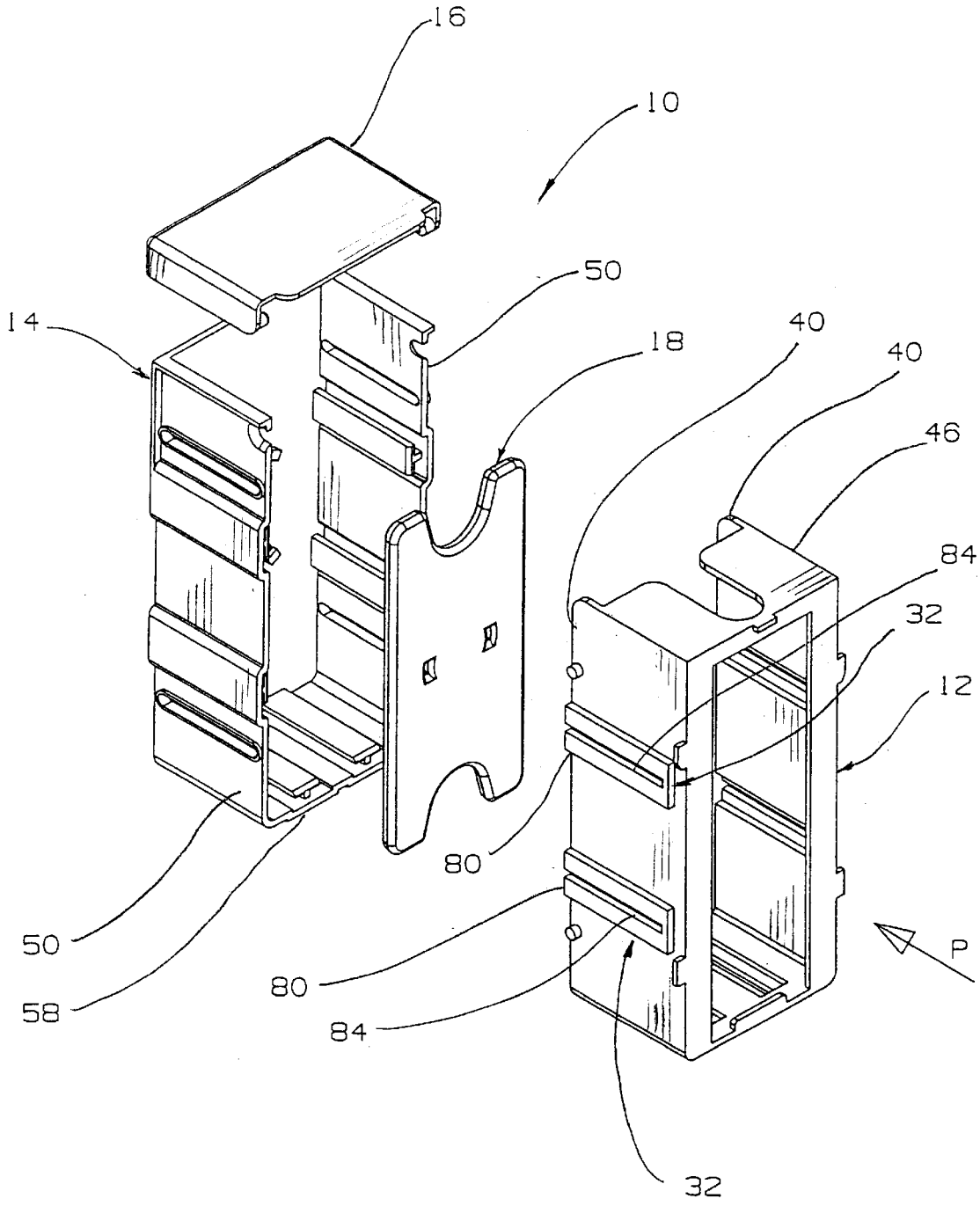
FIG. 12 is an exploded perspective view of a modified cash box.
Figure 13:
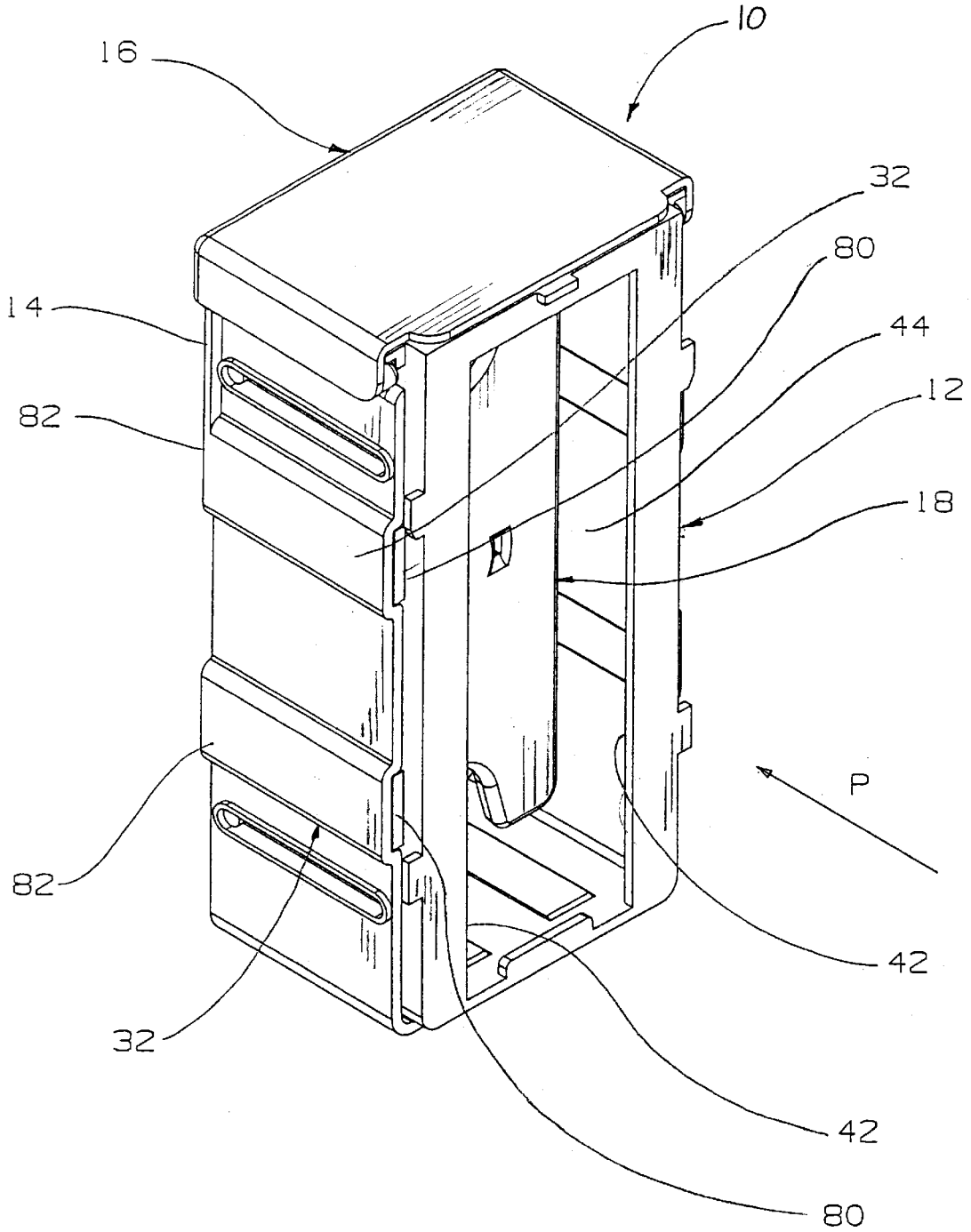
FIG. 13 is a perspective view of the cash box of FIG. 12 in its fully collapsed condition.
Figure 14:
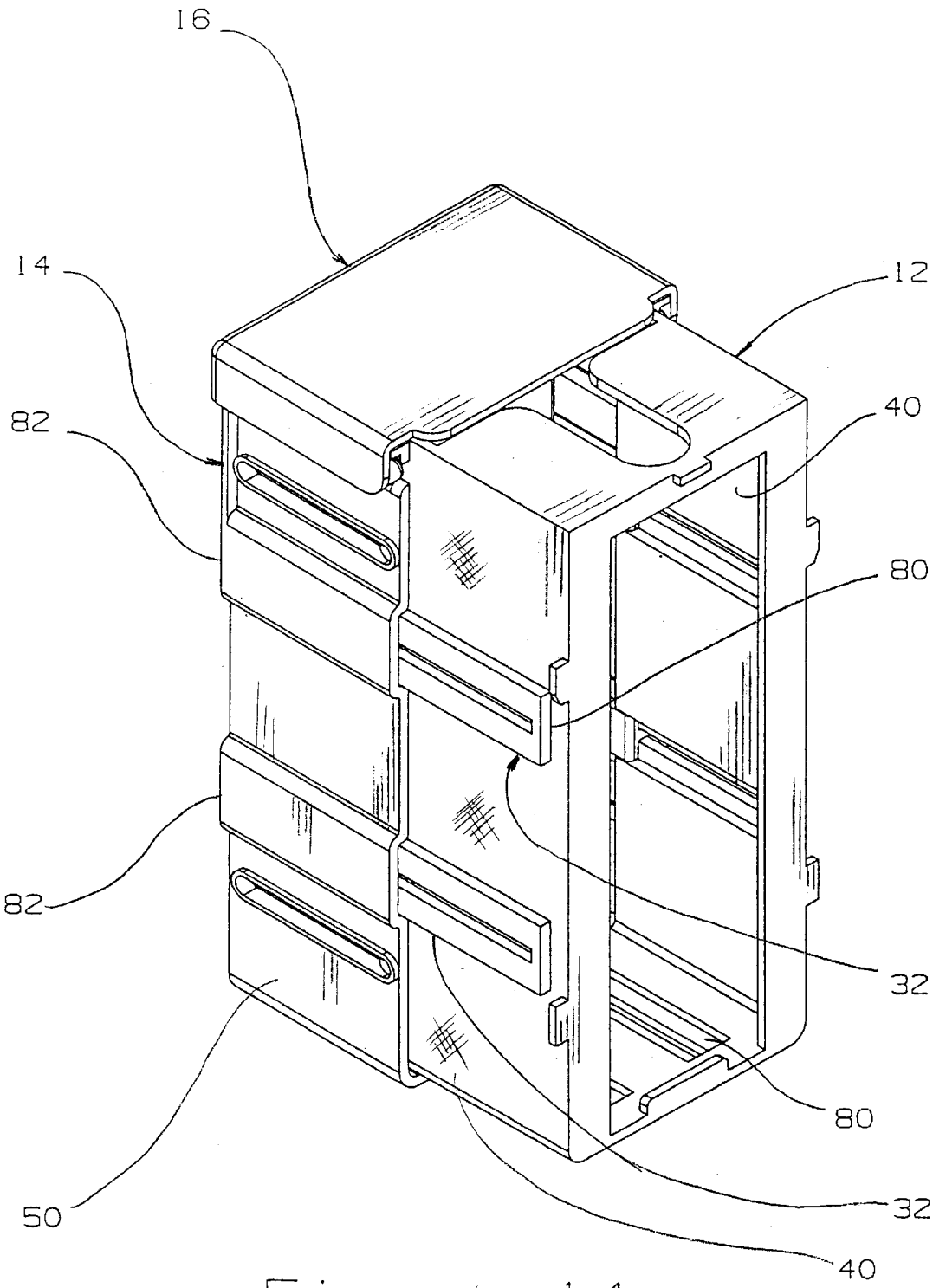
FIG. 14 is a perspective view of the cash box of FIG. 12 in its fully expanded condition.

In the embodiment shown in FIGS. 1–11, the resilient ratchet-like control means 30 provides that the expansion of the cash box depends on the force applied to the sliding enclosure 14 by the compression plate 18 within the cash box by the plunger P, FIGS. 12–14 show a modified embodiment which eliminates the specific control means 30 between the cash box housing portions 12 and 14 and instead provides a control means resulting from the frictional resistance between the inside of the sidewalls 40 and bottom wall 48 of the chassis 12 and the outside of the adjacent sidewalls 50 and bottom wall 58, respectfully, of the sliding enclosure 14, which may be textured to enhance the frictional resistance if desired as shown in FIG. 14. The chassis 12 and sliding enclosure 14 shown in FIGS. 12–14 are in other respects the same as shown in FIGS. 1–11.

Figure 15:
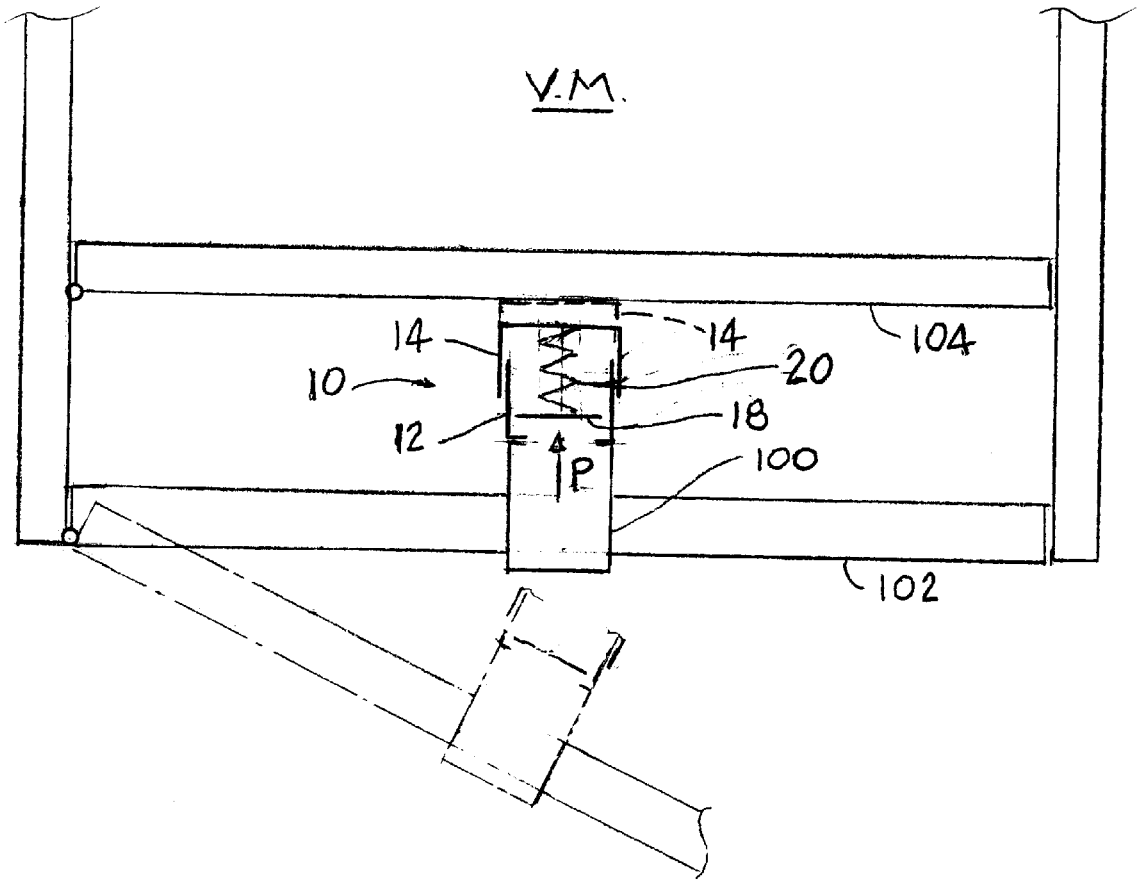
FIG. 15 is a diagrammatic plan view of the cash box mounted to a vending machine.

FIG. 15 illustrates in diagrammatic form the structural arrangement of a vending machine having a bill validator

100 utilizing the cash box 10. As shown, the vending machine 1 has an exterior door 102 and an interior insulation door 104 spaced from the exterior door 102. As shown, the bill validator 100 is mounted to the exterior door 102 and is provided with an expandable cash box 10.

The cash box chassis 12 is mounted directly to the bill validator 100 and the sliding enclosure 14 is received by the chassis 12.

In the event that the space between the exterior door 102 and the interior door 104 is less than the fully expanded cash box portions 12, the cash box will be automatically partially collapsed by engagement with the interior door 104 which provides an exterior stop control means. Thus, the exterior door 102 cannot crush the cash box 10.

On the other hand, if the space between the exterior door 102 and the interior door 104 is greater than the expansion of the cash box 10 the stops provided by pins 92 and slot ends 94 between the cash box housing portions will limit the cash box expansion and provide control means preventing separation of said housing portions.

In the preferred embodiment the expanded capacity of the cash box is about twice the capacity of the collapsed cash box.

Although the cash box 10 has been described by making detailed reference to a preferred embodiments, the details of the description are not to be understood as restrictive numerous variants being possible within the scope of the claims hereunto appended.

I claim as my invention.

1. An expandable cash box for storing bills comprising:

a first housing portion having an open end adapted to receive a bill from a bill validator;

a second housing portion disposed in telescopic sliding relation to the first housing portion;

a spring-loaded compressor plate disposed within said housing portions and adapted to stack and store bills within said housing portions; and means for controlling the sliding telescopic relation between said housing portion and thereby the capacity of the cash box.

2. A cash box as defined in claim 1, wherein:

said means for controlling the telescopic relation between the housing portions includes interacting index members.

3. A cash box as defined in claim 1, wherein:

said means for controlling the telescopic sliding relation between the housing portions includes ratchet means.

4. A cash box as defined in claim 1, wherein:

said means for controlling the telescopic sliding relation between said housing portions includes a plurality of grooves and at least one resilient finger selectively engageable with said grooves.

5. A cash box system as defined in claim 4, in which:

said grooves are disposed on one of said housing portions and said at least one finger is disposed on the other of said housing portions.

6. A cash box as defined in claim 4, wherein:

said first housing portion includes opposed side walls each having a plurality of grooves and the second housing portion includes opposed side walls disposed adjacent associated side walls of the first housing portion and including at least one resilient finger selectively engageable with said grooves.

7. A cash box as defined in claim 6, wherein:

said grooves are fixedly attached to the opposed side walls of said first housing portion and said at least one finger is resiliently attached to associated opposed side walls of said second housing portion.

8. A cash box as defined in claim 7, wherein:

said grooves are disposed in opposed rows and said at least one resilient finger is disposed between said opposed rows of grooves.

9. A cash box system as defined in claim 1, wherein:

means are provided for guiding the telescopic sliding relation between the housing portions to maintain alignment between said housing portions.

10. An expandable cash box for storing bills comprising:

a first hour portion having an open end adapted to receive a bill from a bill validator;

a second housing portion disposed in telescopic sliding relation to the first housing portion;

a spring-loaded compressor plate disposed within said housing portions and adapted to stack and store bills within said housing porions; and means for guiding the housing portions during relative telescopic movement to maintain alignment therebetween.

11. A cash box system as defined in claim 10, wherein:

said guide means includes cooperating elongate slots and projections received by the slots in guided relation.

12. A cash box system as defined in claim 11, wherein:

said first housing portion includes opposed side walls providing said projections and said second housing portion includes opposed side walls providing said slots receiving associated projections in guided relation.

13. A cash box system as defined in claim 11, wherein;

said first housing portion includes opposed side walls having said elongate slots and said second housing portion includes opposed side walls having projections received by said slots in guided relation.

14. A cash box system as defined in claim 10, wherein:

one of said housing portions includes at least one slot having associated slot ends and the other of said housing includes a stop engageable with an associated slot end to prevent separation of said housing portions.

15. A cash box system as defined in claim 10, wherein:

said second housing portion includes an upper portion providing a bill accessible opening, and a cover is provided for said opening.

16. A cash box system as defined in claim 15, wherein:

said cover is hingedly attached to said upper portion.

17. A cash box system as defined in claim 11, wherein:

said recesses include elongate slots, and said projections include T-shaped members received by said slots in retained relation.

18. A cash box system as defined in claim 11, wherein:

said first housing includes opposed side walls and a bottom wall;

said second housing includes opposed side wails and a bottom wall adjacent corresponding side walls and bottom wall of said first housing; and each wall of said first housing includes at least one slot and each wall of said second housing includes at least one T-shaped projection enggageable within an associated slot to provide said cooperating guide members.

19. A cash box as defined in claim 10, further comprising:

means for providing a flat interior surface within the cash box to facilitate movement of bills therewithin.

20. An expandable cash box system for storing bills comprising:

a first housing portion having an open end adapted to receive a bill from a bill validator;

a second housing portion disposed in telescopic sliding relation to the first housing portion;

means for stacking and stoning bills within said housing portions; and means for controlling the sliding telescopic relation between said housing portions and thereby the capacity of the cash box.

21. A cash box system as defined in claim 20, wherein:

the means for controlling the sliding telescopic relation between said housing portions includes friction resistance between the housing portions.

22. A cash box system as defined in claim 20, wherein:

the means for controlling the sliding telescopic relation between said housing portions includes stopmeans between said portions.

23. A cash box system as defined in claim 20, wherein:

the means for controlling the telescopic sliding relation between said housing portions includes an external stop means provided by the vending machine.

24. A cash box system as defined in claim 20, wherein:

the means for controlling the sliding telescopic relation between the housing portions includes friction means between the sliding surfaces of said housing portions.

* * * * *